US007789115B2

(12) United States Patent
Preciado et al.

(10) Patent No.: US 7,789,115 B2
(45) Date of Patent: Sep. 7, 2010

(54) PURSE SLIDE OUT TRAY WITH SLIDE STOP

(75) Inventors: Ralph Preciado, 645 N. San Jacinto, Hemet, CA (US) 92545; Elizabeth Preciado, 645 N. San Jacinto, Hemet, CA (US) 92545

(73) Assignees: Ralph Preciado, Hemet, CA (US); Elizabeth Preciado, Hemet, CA (US)

( * ) Notice: Subject to any disclaimer, the term of this patent is extended or adjusted under 35 U.S.C. 154(b) by 197 days.

(21) Appl. No.: 11/973,256

(22) Filed: Oct. 4, 2007

(65) Prior Publication Data

US 2009/0090443 A1 Apr. 9, 2009

(51) Int. Cl.
*A47B 96/00* (2006.01)

(52) U.S. Cl. ..... 150/113; 150/112; 150/100

(58) Field of Classification Search ..... 150/100, 150/112, 113, 104, 105, 107, 106
See application file for complete search history.

(56) References Cited

U.S. PATENT DOCUMENTS 1,559,307 A * 10/1925 Bernardo ..... 190/111
2,463,993 A * 3/1949 Meyers ..... 150/113
2,788,823 A * 4/1957 Walser ..... 150/113
2,801,666 A * 8/1957 Steele ..... 150/113
3,184,276 A * 5/1965 Billups ..... 312/274
D234,829 S * 4/1975 Edwards ..... D3/285
5,425,577 A * 6/1995 Gembler ..... 312/273
2005/0173034 A1 * 8/2005 Antrobus ..... 150/104

* cited by examiner

*Primary Examiner*—Anthony Stashick
*Assistant Examiner*—Cynthia F Collado
(74) *Attorney, Agent, or Firm*—Donald W. Meeker

(57) ABSTRACT

A slide out tray is housed in a rigid sleeve attached to an inside of a purse. Items placed in the purse through the top of the purse are supported by the sleeve. The sleeve allow the tray to slide in and out of the purse through an opening in a wall of the purse. A hinged cover over the opening pivots to admit the tray therethrough. A tensioned tray holding mechanism associated with the hinged cover secures the tray in any of a variety of locations extending out of the purse to access items in the tray.

5 Claims, 4 Drawing Sheets

PURSE SLIDE OUT TRAY WITH SLIDE STOP

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to storage containers for personal items and particularly to a slide out tray housed in a sleeve inside a purse having a hinged cover over an opening in the purse wall to admit the tray therethrough and a tray holding mechanism associated with the hinged cover for securing the tray in any of a variety of locations extending out of the purse to access items in the tray.

2. Description of Related Art Including Information Disclosed Under 37 CFR 1.97 and 1.98

There is generally a difficulty in finding items stored inside a purse and fumbling for needed items, such as keys or an ID or credit card when the items are needed. Prior art devices do not adequately solve the problem.

U.S. Pat. No. 2,463,993, issued Mar. 8, 1949 to Meyers, is for a handbag having an upper and lower compartments and a removable drawer in the lower compartment.

U.S. Pat. No. 246,179, issued Aug. 23, 1881 to Meaker, describes a pocket book or wallet which has a drawer that slides out of an end of the purse.

U.S. Pat. No. 285,305, issued Sep. 18, 1883 to Peirson, claims a traveling satchel which has an upper compartment and a lower compartment. The lower compartment houses a sliding drawer.

U.S. Pat. No. 1,559,307, issued Oct. 27, 1925 to Bernardo, provides a hand traveling bag having an upper and a lower compartment, which may be constructed with a slidable drawer in its lower compartment.

U.S. Pat. No. 659,058, issued Oct. 2, 1900 to Edlen, shows a surgeon's case having a slidable sterilizing pan in a lower compartment.

What is needed is a means for separating commonly needed items from other items stored in a purse and make the needed items readily accessible for use without fumbling through other items in the purse.

BRIEF SUMMARY OF THE INVENTION

An object of the present invention is to provide a slide out tray housed in a sleeve inside a purse having a hinged cover over an opening in the purse wall to admit the tray therethrough and a tray holding mechanism associated with the hinged cover for securing the tray in any of a variety of locations extending out of the purse to access items in the tray that are frequently needed without having to fumble through all the items in the purse.

In brief, the slide out tray of the present invention housed in a rigid sleeve attached to a bottom of a purse to support items placed in the purse through the top of the purse and allow the tray to slide in and out of the purse within the sleeve. A hinged cover over an opening in the purse wall pivots to admit the tray therethrough and a tensioned tray holding mechanism associated with the hinged cover secures the tray in any of a variety of locations extending out of the purse to access items in the tray.

An advantage of the present invention is that it provides easy and rapid access to needed items in a purse without having to fumble through all the items in the purse and without spilling the items stored in the tray.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

In FIGS. 1-9, a slide out tray and tray stop device 10 for a purse comprises a tray 30 housed slidably in a rigid sleeve 20 secured within the purse 50.

Figure 1:
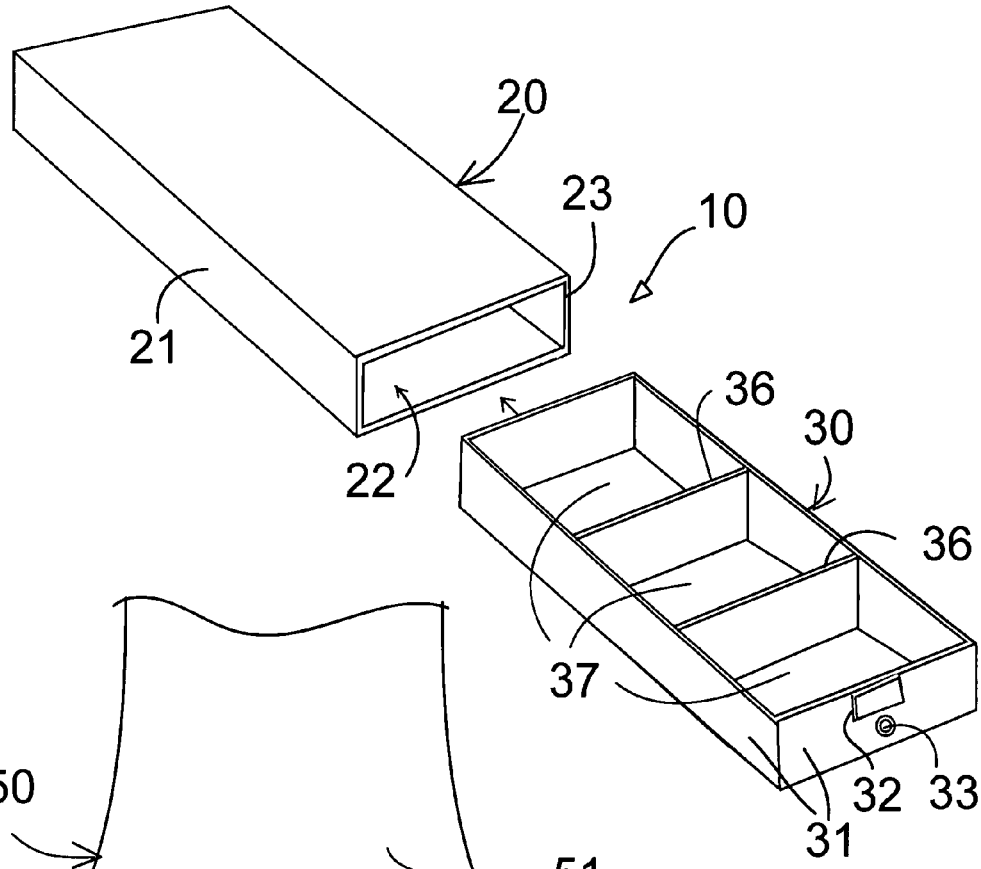
FIG. 1 is a perspective view of the tray and sleeve inserts for a purse of the present invention showing the tray aligned for insertion in the sleeve.
Figure 2:
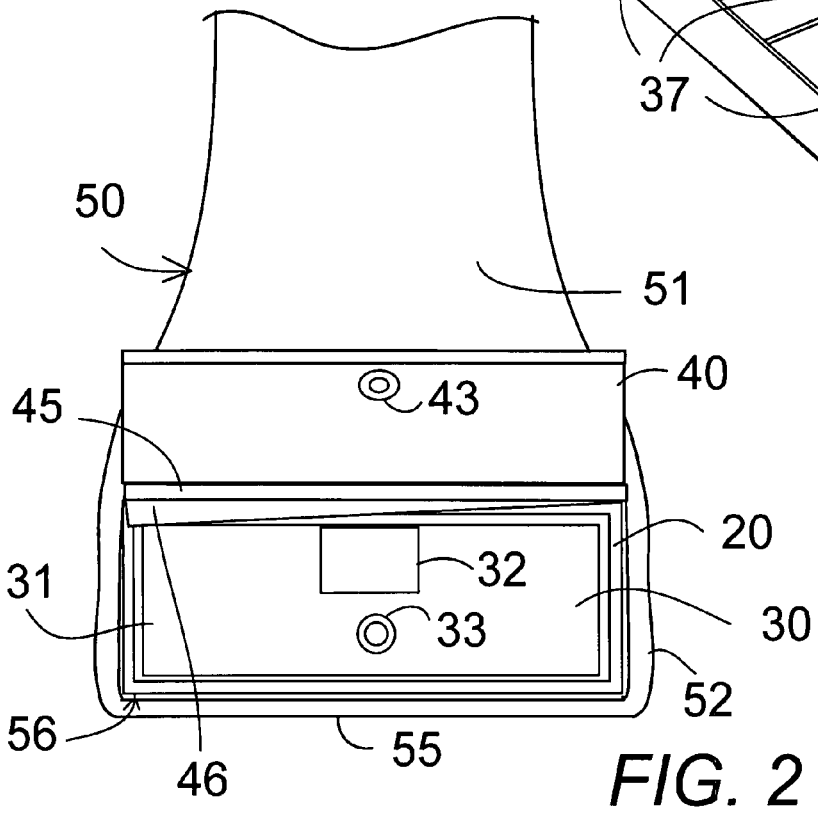
FIG. 2 is a partial elevational view of the tray and sleeve of FIG. 1 installed in a purse with the door on the end of the purse lifted to reveal the tray and sleeve inside the purse.

The tray 30 has at least one and preferably a number of compartments 37 for receiving articles contained in a purse to slide the tray out of the purse to access the items in the tray without disturbing the other contents of the purse. The tray is slibably insertable through an opening 56 in an end wall 51 of the purse between a first position completely within the purse for storage of articles contained in the tray, as shown in FIGS. 2 and 5, and any of a variety of second positions with the tray a least partially extending out of the purse for retrieving articles therefrom and storing articles therein, as shown in FIGS. 3, 4, 6, 7, and 9.

The sleeve 20 is attached horizontally to an inside portion of a purse 50, preferably to the bottom 55 of the purse by an adhesive, rivets or other fastening means. The sleeve 20 comprising an exterior surface 21 surrounding an interior space 22 for receiving the tray slidably inserted therein. The sleeve exterior surface 21 is sufficiently rigid to support any contents contained in the purse and prevent any articles in the purse from entering or bending the exterior surface. The sleeve having at least one end opening 23 communicating with the interior space 22 therein to receive the tray 30 slibably inserted therein. The at least one sleeve end opening 23 aligned with the purse tray receiving opening 56.

Figure 5:
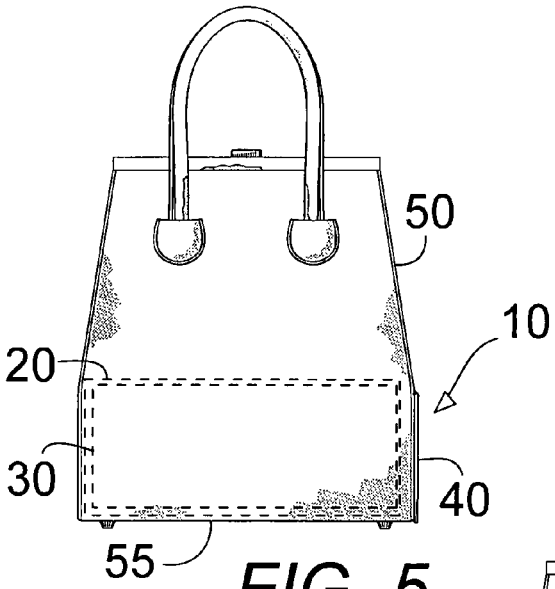
FIG. 5 is a side elevational view of the purse with the tray and sleeve of FIG. 1 shown dashed attached to the inside of the purse at the bottom of the purse.
Figure 6:
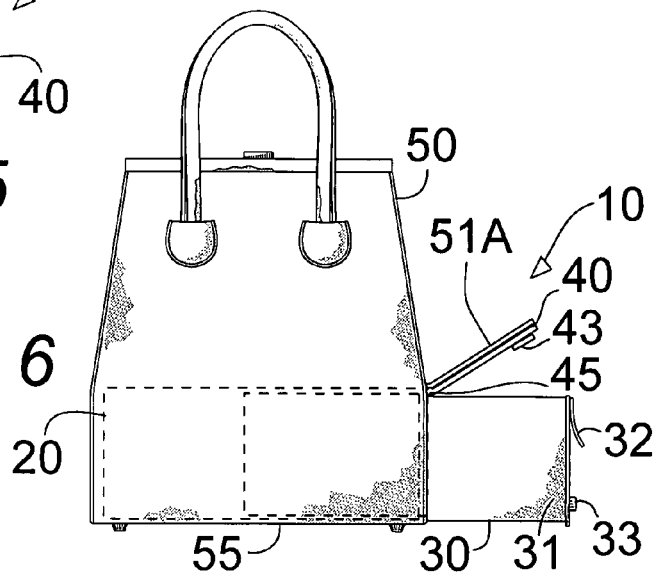
FIG. 6 is a side elevational view of the purse with the tray and sleeve of FIG. 1 shown dashed attached to the inside of the purse at the bottom of the purse with the tray extending partially out of the sleeve and a portion of the hinge of the open door bearing down on the tray to hold it in place.
Figure 7:
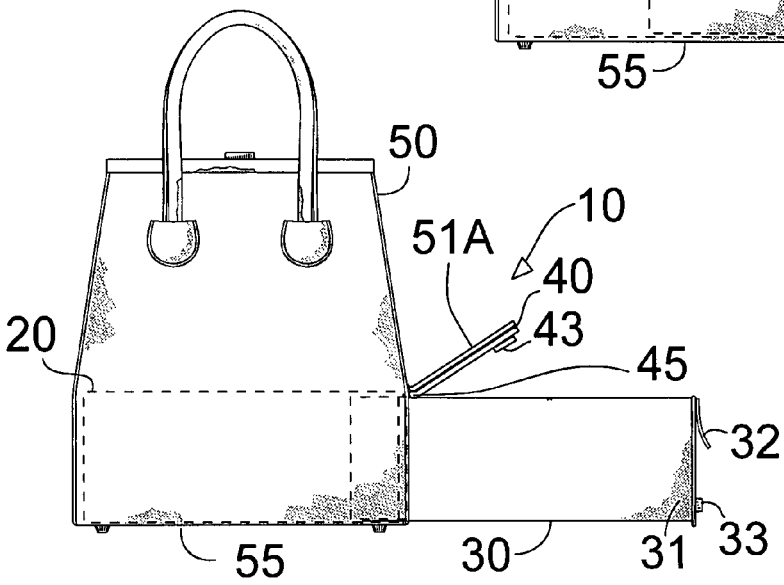
FIG. 7 is a side elevational view of the purse with the tray and sleeve of FIG. 1 shown dashed attached to the inside of the purse at the bottom of the purse with the tray extending substantially out of the sleeve and a portion of the hinge of the open door bearing down on the tray to hold it in place.
Figure 8:
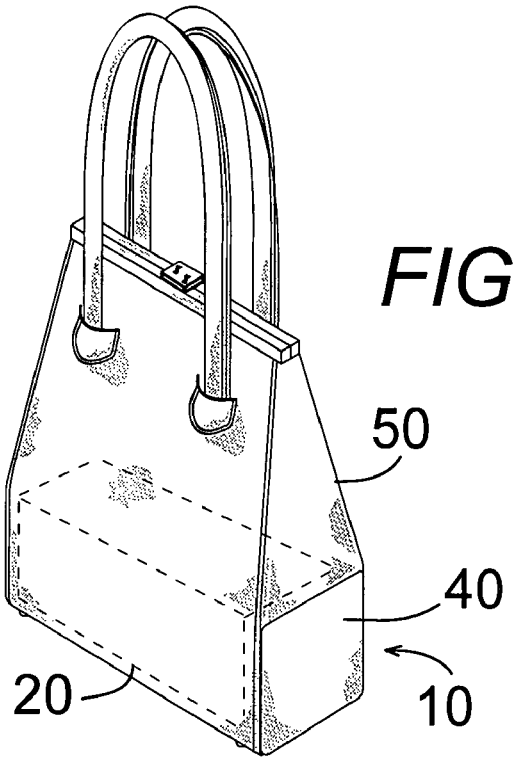
FIG. 8 is a perspective view of the purse with the tray and sleeve of FIG. 1 shown dashed attached to the inside of the purse at the bottom of the purse.
Figure 9:
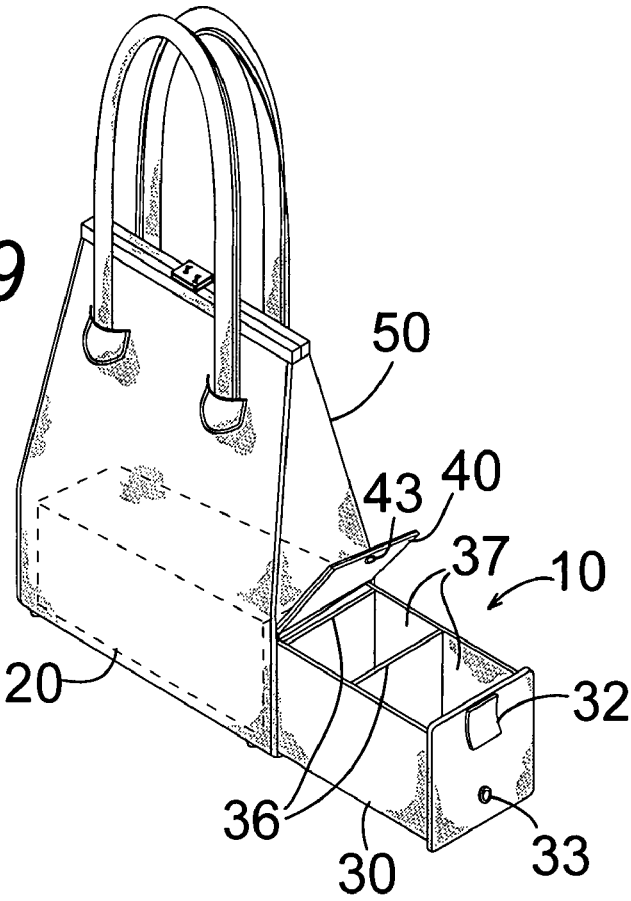
FIG. 9 is a perspective view of the purse with the tray and sleeve of FIG. 1 shown dashed attached to the inside of the purse at the bottom of the purse with the tray extending partially out of the sleeve and a portion of the hinge of the open door bearing down on the tray to hold it in place.

A door 40 normally covers the opening 56 on the wall of the purse 50, as shown in FIGS. 5 and 8. The door 40 is covered by the same outer covering 51A as the purse covering 51. The door 40 is attached by a hinge 45, preferably a plastic living hinge, along one side to a portion of the purse wall 51 bordering the opening 56 therein so that the door 40 pivots open for accessing the tray, as in FIGS. 3, 4, 6, 7, and 9, and closed for containing the tray inside the purse, as in FIGS. 5 and 8. The door 40 comprises means for biasing the door in a normally closed position which may be the living hinge, a spring or other tension means. The door further comprises means for securing the door closed, which may be mating fasteners, such as mating snaps 43 and 33 on the door and the front of the tray. The door also comprises means, such as an extension 46 of the living hinge, for securing the tray 30 in any desired extended position with the door in an open position, as shown in FIGS. 4, 6, 7, and 9.

A pull tab 32 or other device attached or built in to the front of the tray serves as a means for grasping the tray 30 to slide the tray out of the purse 50.

The tray 30 and sleeve 20 are fabricated of relatively rigid material which could be plastic or some type of fiber board and preferably covered on exposed surfaces by a tray covering material 31 matching the purse covering material 51. Partitions 36 dividing the tray 30 into separate compartments 37 may also be covered with material mating the purse covering material. The living hinge 45 may connect the door 40 with a sheet of door extension material 49 attached by adhesive or other means to the inside of the purse covering material 51.

Figure 3:
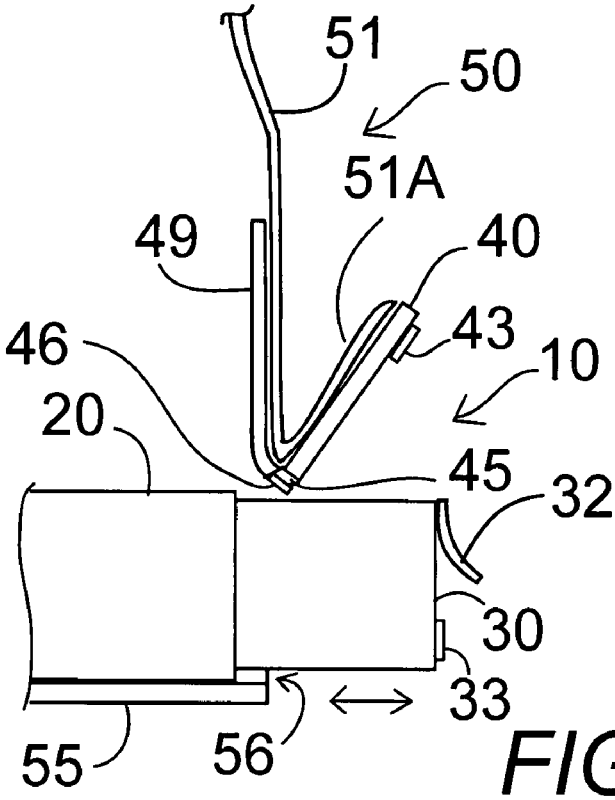
FIG. 3 is a partial side elevational view of the tray and sleeve of FIG. 1 installed within a purse shown in partial section with the door of the purse held up to allow the tray to slide out.
Figure 4:
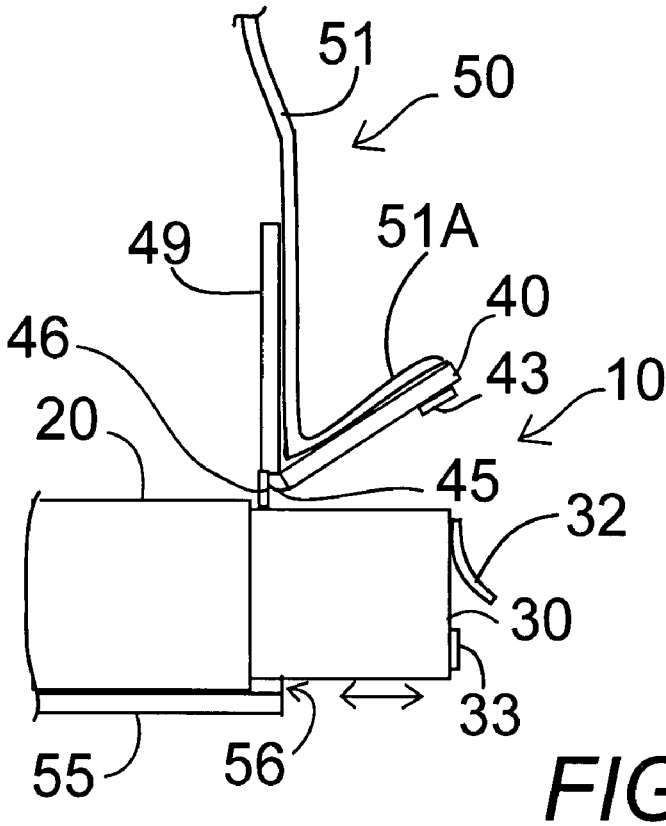
FIG. 4 is a partial side elevational view of the tray and sleeve of FIG. 1 installed within a purse shown in partial section with the door of the purse released so that a portion of the hinge bears down on the tray to secure the tray in place to allow access to the contents of the tray without the tray sliding out further.

In use, the door 40 is lifted, the tray 30 slid out of the sleeve 20, as in FIG. 3, and the door released, as in FIGS. 4, 6, 7, and 9 to secure the tray from sliding so that a user can retrieve items from the tray or place items in the tray.

It is understood that the preceding description is given merely by way of illustration and not in limitation of the invention and that various modifications may be made thereto without departing from the spirit of the invention as claimed.

What is claimed is:

1. A slide out tray and tray stop device for a purse, the device comprising:

a tray having at least one compartment for receiving articles contained in a purse, the tray slibably insertable through an opening in a wall of the purse between a first position completely within the purse for storage of articles contained in the tray and any of a variety of second positions with the tray a least partially extending out of the purse for retrieving articles therefrom and storing articles therein;

a sleeve attached horizontally to an inside portion of a purse, the sleeve comprising an exterior surface surrounding an interior space for receiving the tray slidably inserted therein, the sleeve exterior surface being sufficiently rigid to support any contents contained in the purse and prevent any articles in the purse from entering or bending the exterior surface, the sleeve having at least one end opening therein to receive the tray slibably inserted therein, the at least one end opening aligned with the purse tray receiving opening;

a door normally covering the opening on the wall of the purse, the door attached by a hinge along one side to a portion of the purse wall bordering the opening therein so that the door pivots open for accessing the tray and closed for containing the tray inside the purse, the door comprising means for biasing the door in a normally closed position, means for securing the door closed, and means for securing the tray in any desired extended position with the door in an open position, the means for biasing the door in a closed position comprising a tensioned hinge and the means for holding the tray in place in any of a variety of extended positions comprising an angled portion of the hinge which contacts and holds the tray in place with the door open and the tray extended.

2. The device of claim 1 wherein the means for securing the door closed comprises mating fasteners between the door and the tray.

3. The device of claim 2 wherein the mating fasteners comprise mating snap fasteners.

4. The device of claim 1 further comprising means for grasping the tray to slide the tray out of the purse.

5. The device of claim 4 wherein the means for grasping the tray comprises a pull tab on the tray.

* * * * *